United States Patent [19]

Baumann et al.

[11] 4,105,057

[45] Aug. 8, 1978

[54] FLEXIBLE RECEPTACLE WITH CREDIT CARD HOLDER

[75] Inventors: Terry F. Baumann, Milwaukee; Gerald W. Brummer, West Bend, both of Wis.

[73] Assignee: Amity Leather Products Company, West Bend, Wis.

[21] Appl. No.: 835,890

[22] Filed: Sep. 23, 1977

[51] Int. Cl.[2] ..... A45C 1/06

[52] U.S. Cl. ..... 150/35; 150/39

[58] Field of Search ..... 150/35, 39; 40/124.2, 40/124.4, 104.19

[56] References Cited

U.S. PATENT DOCUMENTS

| | | | |
|---|---|---|---|
| 1,850,362 | 3/1932 | Vogel | 40/124.4 |
| 2,219,807 | 10/1940 | Buxton | 150/39 |
| 2,226,976 | 12/1940 | Leaming | 40/104.19 |
| 2,477,886 | 8/1949 | McCaskill | 40/104.19 X |
| 4,008,742 | 2/1977 | Lemler | 150/35 |

*Primary Examiner*—Donald F. Norton
*Attorney, Agent, or Firm*—James E. Nilles

[57] ABSTRACT

A credit card holder for a billfold, wallet, or the like and for holding a plurality of credit cards in shingled, overlapping relationship. The holder has an outer flexible wall with a series of parallel, spaced apart slits which define a plurality of parallel adjacent strips. An inner flexible pocket or liner of generally rectangular shape is received in back-to-back relationship against the rear surface of the outer flexible wall member and the inner flexible linerhas a plurality of pairs of slits, the slits of each pair being spaced laterally apart from one another so as to define a central solid wall in the liner that can absorb stresses which are imposed on the liner when the card is inserted into the spaced apart slits. The slits of the liner are aligned with the respective parallel slits in the flexible wall member so that the flexible flaps which are formed by the slits in the liner lie adjacent to their respective slit in the flexible wall and are glued thereto. When a credit card is received through the aligned slits of the flexible wall and inner flexible liner, it is supported at a central location of the card and by the solid wall of the liner.

1 Claim, 6 Drawing Figures

FLEXIBLE RECEPTACLE WITH CREDIT CARD HOLDER

BACKGROUND OF THE INVENTION

The present invention relates to a credit card holders of the general type shown in U.S. Pat. No. 3,856,063 issued Dec. 24, 1974 to Jan Peter Dengel and wherein a plastic multi-purpose liner is used behind an outer wall of the wallet having parallel slits therein. The plastic liner is formed with a smooth backside which prevents obstruction of items inserted in an open pocket behind the liner. Another example of the prior art is shown in U.S. Pat. No. 4,008,742 issued Feb. 22, 1977 to Paul M. Lemler and the present invention is directed to an improvement over this particular type of credit card holder. The flexible liner of said U.S. Pat. No. 4,008,742 is formed so that the card is supported by individual flexible flaps centrally located in the liner and in which no central one-piece supporting structure of the liner is provided; while the device of the said U.S. Pat. No. 4,008,742 has proven to be commercially successful, it did have certain shortcomings in that the liner became distorted, did not entirely absorb the stress imposed upon it when the card was forcefully inserted therein, the pockets tended to loose their shape, and the slits became bent.

Both of the above two patents have been assigned to an assignee common with the present invention.

SUMMARY OF THE PRESENT INVENTION

The present invention provides a flexible receptacle such as a billfold or the like and which includes a credit card holder for holding a series of credit cards in shingled, overlapping relationship, the holder having a flexible liner containing pairs of slits formed therein, the slits of each pair being disposed laterally of one another and having their inner adjacent edges curved and wherein the liner has a central, un-cut or solid portion extending vertically therethrough its height and which serves to efficiently absorb stress imposed upon the liner when the cards are inserted in the pairs of laterally spaced slits. The slits formed in the liner define flexible flaps having large glue areas whereby the flexible flaps are securely fastened to an outer flexible wall of the receptacle. The arrangement is such that the slits in the outer flexible wall are aligned with the corresponding pair of slits in the inner liner, and the flaps of the liner are glued adjacent to the slits formed in the outer wall.

The invention relates to a flexible receptacle of the above mentioned type and in which (1) cards can be inserted by either the left or right hand due to the curved edges of the flaps of the liner; (2) the liner provides a straight, unobstructed or solid portion which absorbs the stress imposed upon the liner when cards are forcefully inserted in the slits; (3) the pockets formed by the outer flexible wall and the liner maintain their shape with no distortion and with less wear, due primarily to the fact that the load is carried by the entire central portion of the liner; (4) a large adhesive area is provided for fastening the flexible flaps of the liner to the back side of the outer flexible wall; and (5) the curved slits formed in laterally spaced pairs on the liner terminate at their inner edges in a hooked shaped portion which prevents tearing of the liner by the card inserted therein.

These and other objects and advantages of the present invention will appear hereinafter as this disclosure progresses, reference being had to the accompanying drawings.

BRIEF DESCRIPTION OF THE DRAWINGS

FIG. 4 is a perspective view of the line shown in FIG. 2, but showing the rear fold of the liner as when moved away from the front wall of the liner about the perforated edge which connects them;

DESCRIPTION OF THE PREFERRED EMBODIMENT

Figure 1:
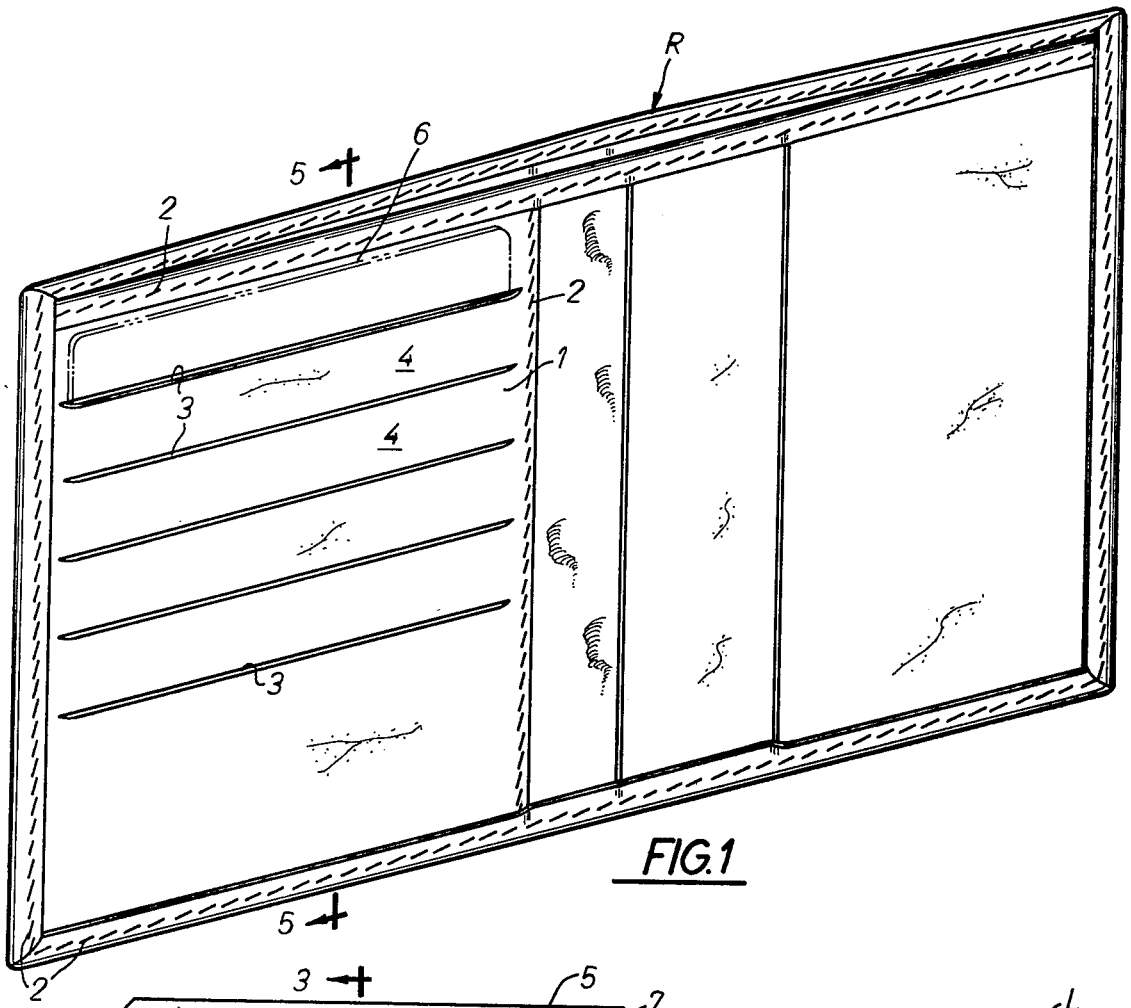
FIG. 1 is a perspective view of a flexible receptacle such as a billfold embodying the present invention, the view being taken from the inside of the wallet and showing the slits in the outer flexible member thereof.

The flexible receptacle R provided by the present invention includes a generally rectangular flexible front wall 1 which is secured to the remainder of the receptacle by sewing around its periphery as indicated at 2. This flexible front wall includes a series of parallel slits 3 formed therein which define a plurality of parallel strips 4 in said front wall 1. It is through these slits 3 that the credit cards 6 to be held are inserted in shingled, over-lapping relationship in the known manner.

Behind the flexible, slitted wall 1 is located the liner L and this liner L is glued at the areas bounded by the dotted lines 7 to the inner or backside of the flexible wall 1. The liner L includes the wall 8 which is hinged together by the perforation 9 along one side to the back guide panel 5 of the liner. The guide panel 5 serves to properly orientate and rigidify the wall 8.

Figure 2:
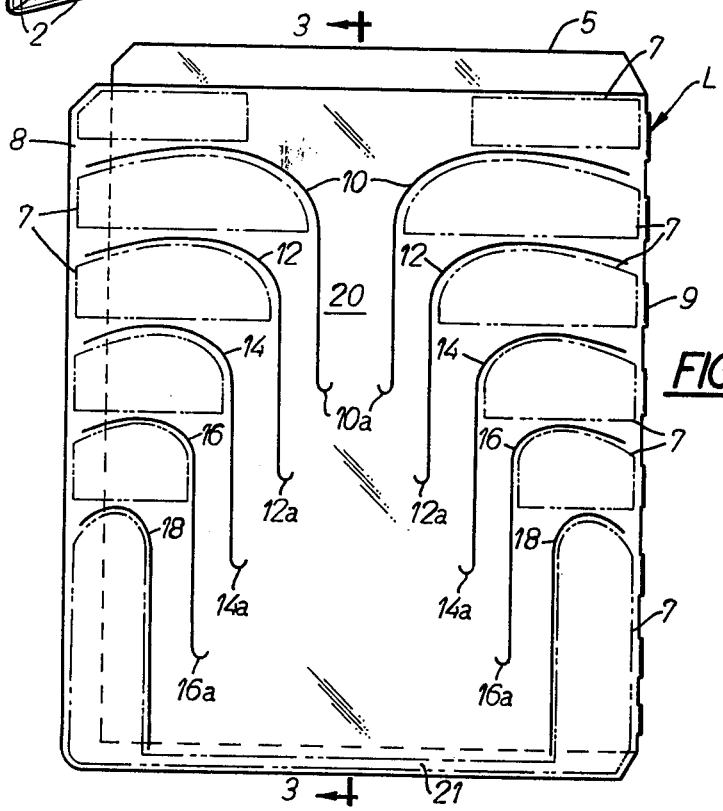
FIG. 2 is an elevational view of the liner inserted in the wallet behind the slitted outer wall thereof and which is glued to the outer flexible wall of the wallet at the broken line glue areas shown in the figure.
Figure 3:
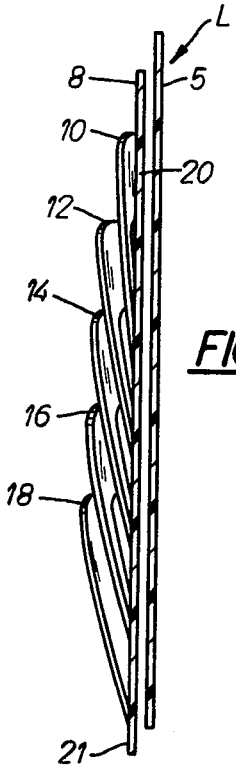
Figure 4:
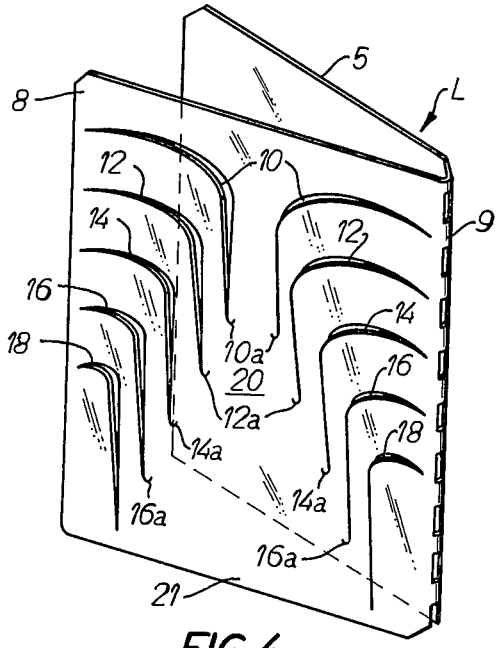
FIG. 4 is a sectional view taken generally along the line 3—3 in FIG. 2.

Referring particularly to FIGS. 2 and 4, a plurality of pairs of slits 10, 12, 14, 16, and 18 are formed in the wall 8 of the liner, the slits of each pair being spaced laterally apart from one another and terminating a distance from one another so that a central unobstructed or un-cut portion 20 of the liner is provided and which extends for the major height of the liner. It is this portion 20 of the liner that absorbs the stress imposed upon the liner when a card is inserted in the slits as will appear. It should furthermore be noted that the inner adjacent edges of each slit of the pairs of slits are curved towards one another and in an inwardly and downwardly converging direction. It is this particular curved shape of the liner slits that enables the card to be readily inserted in the slits as will appear, and with either the left or right hand of the user. Furthermore, the lower end of each slit terminates in a curved portion **10*a*, 12*a*, 14*a*, and 16*a* and it is this curved portion that prevents tearing of the liner when the card is too forcefully inserted therein. It will be noted that the lowermost slit 18 requires no hook or curved portion because a connecting portion 21 of the liner between the curved slits 18**.

Figure 5:
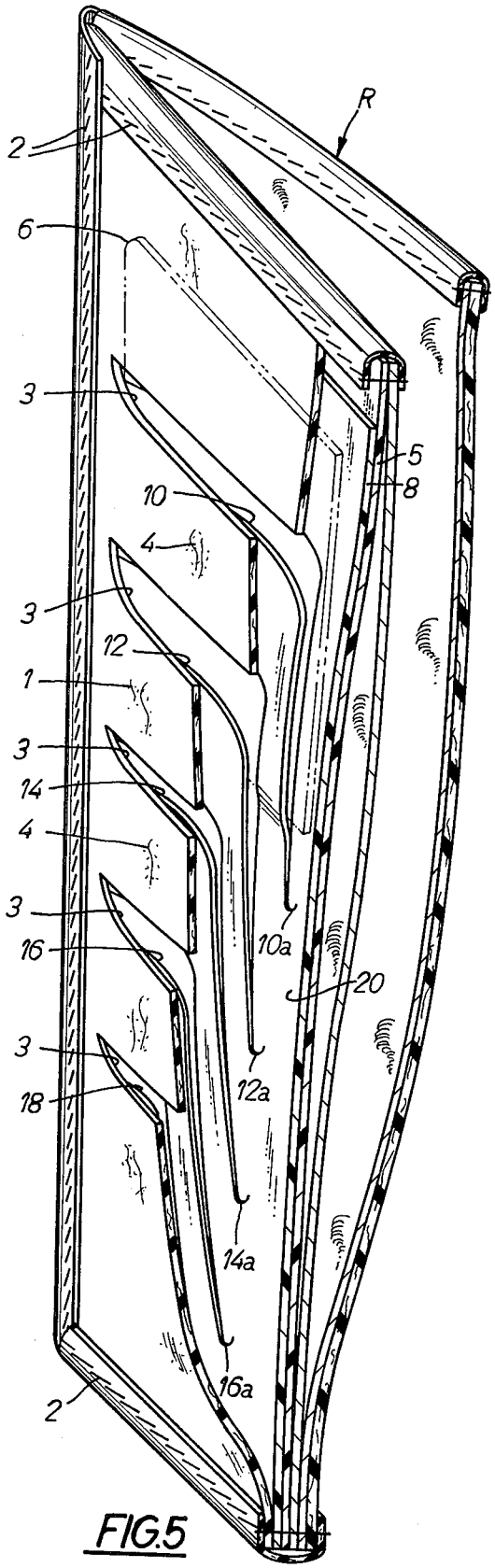
FIG. 5 is an enlarged view in section, taken generally along the line 5—5 in FIG. 1, but showing the various parts of the wallet when distorted or moved for clarity in the drawings.

Also indicated in FIG. 2 by the broken lines 7 are the glue areas to which glue is applied so that the curved flaps formed by the slits of the liner can be securely glued to the backside of the flexible wall 1 which is shown in FIG. 1 and this relationship is also clearly shown in FIG. 5. It will be noted that considerable glue areas are provided by the present invention which contributes to the wearing quality and life of the present credit card receptacle.

Figure 6:
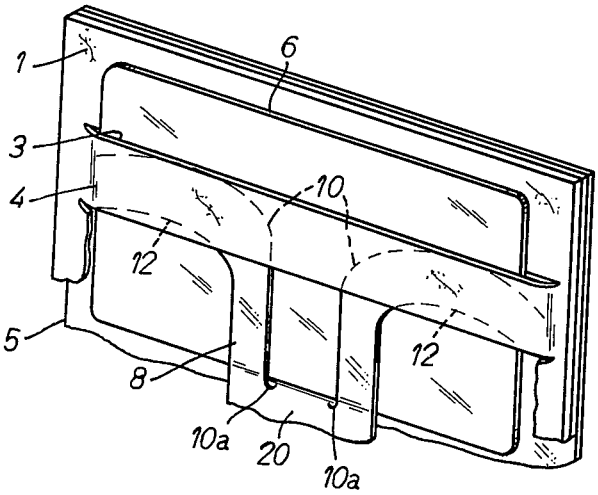
FIG. 6 is a view of a portion of the left hand part of the wallet as shown in FIG. 1, but certain parts of the front flexible wall of the liner being broken away for the sake of clarity and furthermore showing a credit card inserted in one of the pockets formed by the present invention, the slits of the liner being shown in broken lines.

When assembled, it will be noted, particularly from FIGS. 5 and 6 that the top edges of the liner flaps, that is the top portion of the slits of the liner lie closely adjacent their respective parallel slits 3 of the flexible wall 1. Thus, the slits 3 of the flexible wall with their corresponding slits of the liner act as a single slit when the assembly is glued together and which thus receive the individual cards into the pockets formed by the assembly.

The present invention provides a particularly efficent and economically produced liner which can be assembled readily and securely held to the flexible outer wall 1 of the receptacle. The vertical, central portion of the liner is un-cut, i.e., it is unobstructed and remains in one piece which acts to efficiently absorb the thrust or stress imposed on the liner by the forceful insertion of the card into the pockets. The large glue area provided also contributes to good holding capabilities of the liner. The entire arrangement insures that the receptacle and particularly the slitted pockets are not distored and instead maintain their shape and that wear thereof is minimized. The cards can be quickly and easily inserted in either direction into the pockets and easily removed therefrom.

We claim:

1. A flexible receptacle such as a billfold or the like and including a credit card holder for holding a series of credit cards in shingled, overlapping relationship, said receptacle comprising an outer flexible wall having a series of spaced apart parallel slits therein and which in turn define a series of parallel flaps, said card holder including a flexible liner located against a back-side of said outer flexible wall, said flexible liner having a plurality of pairs of curved slits therein, said pairs of slits being spaced apart from one another in a vertical direction in said liner, the slits of each pair of slits being spaced apart from one another in a lateral direction in said liner and defining a central portion of said liner which is unobstructed and of one-piece construction for the major portion of the height of said liner, the slits of each pair of slits curved inwardly a substantial distance and then downwardy as they approach towards one another and adjacent slits in a vertical direction are sufficiently spaced apart from one another so as to form flexible liner flaps of considerable glue area, said liner slits also having an upper portion which is located closely adjacent the corresponding said slits of said outer flexible wall so as to form a single slit therewith for the insertion of a credit card therethrough, said liner flaps glued adjacent the upper portion of said curved slits to their respective flaps of said outer wall, each of said pairs of slits having lower parallel portions which between them define said central portion, whereby when said card is inserted through the aligned slits of said outer wall and said liner, said cards are supported by said central unobstructed portion of said liner, said parallel portions terminating in lower hooked shaped ends, said hook shaped ends acting to prevent tearing of said liner when a card is inserted in said slits, said liner including a back panel hingedly mounted thereon and inserted in said receptacle and against the said back side of said outer flexible wall for guiding and rigidifying said liner.

* * * * *